United States Patent [19]

Tuckey et al.

[11] 4,094,934

[45] June 13, 1978

[54] HORIZONTAL UPDRAFT CARBURETOR

[75] Inventors: Charles H. Tuckey; Roy J. Tuckey, both of Caro, Mich.

[73] Assignee: Tuckey Corporation, Caro, Mich.

[21] Appl. No.: 771,817

[22] Filed: Feb. 23, 1977

[51] Int. Cl.[2] ..... F02M 1/02

[52] U.S. Cl. ..... 261/64 R; 261/78 R; 261/DIG. 39

[58] Field of Search ..... 261/64 R, 64 E, DIG. 39, 261/78 R, 61

[56] References Cited

U.S. PATENT DOCUMENTS

| | | | |
|---|---|---|---|
| 1,246,581 | 11/1917 | Friend | 261/DIG. 39 |
| 1,275,150 | 8/1918 | Gray | 261/64 R |
| 1,527,913 | 2/1925 | Payne | 261/DIG. 39 |
| 2,152,951 | 4/1939 | Bracke | 261/64 R |
| 2,744,736 | 5/1956 | Evinrude | 261/64 R |
| 3,038,706 | 6/1962 | Ball | 261/64 R |

FOREIGN PATENT DOCUMENTS

| | | | |
|---|---|---|---|
| 571,698 | 2/1924 | France | 261/DIG. 39 |
| 401,919 | 9/1924 | Germany | 261/DIG. 39 |
| 292,174 | 1/1929 | United Kingdom | 261/64 R |

*Primary Examiner*—Tim R. Miles
*Attorney, Agent, or Firm*—Learman & McCulloch

[57] ABSTRACT

An air flow directing ramp in the air intake passage of a horizontal updraft carburetor defines an air flow passage of reduced cross sectional area which, among other functions, establishes an increased air flow velocity during starting operations and directs this flow to the main nozzle of the carburetor. The main nozzle is provided with an outwardly flared discharge extension having restricted air passages which substantially improve the mixing action. The pivotally mounted choke plate, located upstream of the air intake passage from the velocity ramp is formed with a restricted opening constituting an air inlet to the air flow passage of the ramp when the choke is closed, while an upwardly curved lip portion of the choke plate cooperates with the upwardly curved velocity ramp when the choke is opened to provide a smooth deflection of intake air from the horizontal intake passage to the vertical mixing chamber.

4 Claims, 6 Drawing Figures

HORIZONTAL UPDRAFT CARBURETOR

BACKGROUND OF THE INVENTION

The invention is directed generally to the improvement of air flow characteristics in horizontal updraft carburetors with the objectives of improving starting characteristics, reducing fuel waste and fuel drip, improving emission control, and improving the fuel-air mixture characteristics to improve engine efficiency and to reduce exhaust emissions.

SUMMARY OF THE INVENTION

In accordance with the invention, a velocity ramp is mounted in the air intake passage of a horizontal updraft carburetor between the choke plate and the main fuel nozzle. The ramp may taken the form of a pair of spaced parallel side plates projecting vertically upwardly from the bottom of the intake passage with a smoothly upwardly curved rear wall extending between the side plates to direct air flowing between the side plates from horizontal flow to a substantially vertical flow directed toward the fuel nozzle. When the choke plate is in its closed position, the plate engages and extends between the front edges of the ramp side plates and a relatively small opening through the choke plate defines an air inlet to the reduced air flow passage between the ramp side plates. When the choke is in its open position, the choke lies across the top edges of the side plates of the velocity ramp and an upwardly curved lip at the rearward end of the open choke plate cooperates with the curved portion of the velocity ramp to smoothly deflect air in the intake passage upwardly toward the vertical mixing chamber. The main nozzle of the carburetor is provided with an outwardly flared extension having restricted passages which provides an improved mixing action.

Other objects and features of the invention will become apparent by reference to the following specification and to the drawings.

IN THE DRAWINGS

Figure 1:
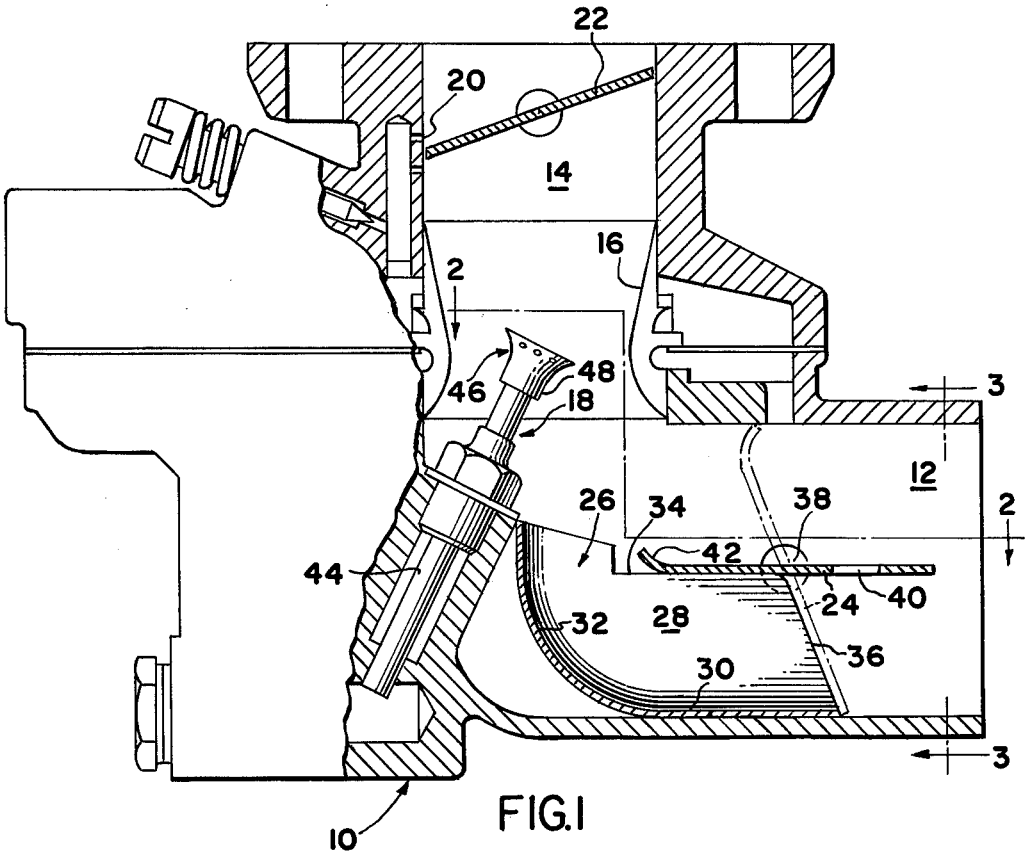
FIG. 1 is a side elevational view, partially in section, of a horizontal updraft carburetor embodying the present invention.

A carburetor embodying the present invention includes a housing designated generally 10 formed with a horizontal air intake passage 12 which merges at its downstream end with a vertically extending mixing chamber 14, the walls of which include a venturi section 16 (FIG. 1). A main nozzle assembly 18 projects into the venturi section 16 of mixing chamber 14 to introduce a fuel mixture into the throat of the venturi for mixture with air supplied via intake passage 12. The supply of fuel to main nozzle assembly 18 is by conventional means, as is likewise the supply of fuel to an idle nozzle 20 (FIG. 1) employed to supply fuel to the associated engine when the conventional throttle valve 22 of the carburetor is in the closed position shown in FIG. 1. A choke plate 24 is mounted for pivotal movement in intake passage 12 between a fully open position shown in full line in FIG. 1 and a closed position shown in broken line in FIG. 1. The choke is actuated by conventional mechanism, not shown, in a well-know manner.

In accordance with the present invention, a velocity ramp designated generally 26 is mounted at the bottom of intake passage 12 between choke 24 and main nozzle assembly 18 and is fixedly secured in the position shown in the passage by any suitable means, not shown. Ramp 26 includes a pair of spaced parallel vertically extending side plates 28 which are joined to each other by a transversely extending bottom wall 30 which merges at its rearward end (left-hand end as viewed in FIGS. 1 and 2) with a smoothly upwardly curved rear wall 32. The top and front (right-hand as viewed in FIGS. 1 and 2) ends of ramp 28 are open so that the ramp in effect may be described as an open ended trough occupying the lower central portion of the intake passage.

Figure 2:
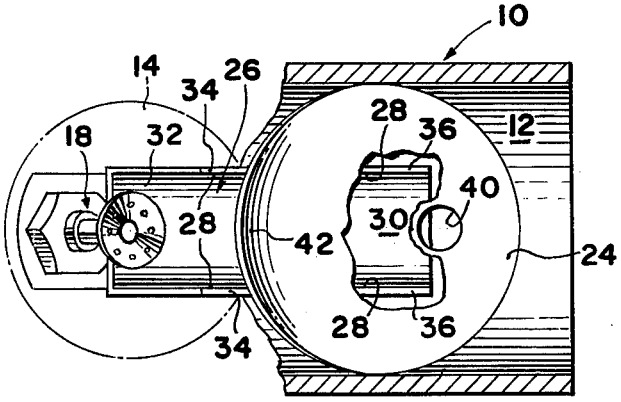
FIG. 2 is a detailed cross-section view of the carburetor of FIG. 1 taken on line 2—2 of FIG. 1.
Figure 3:
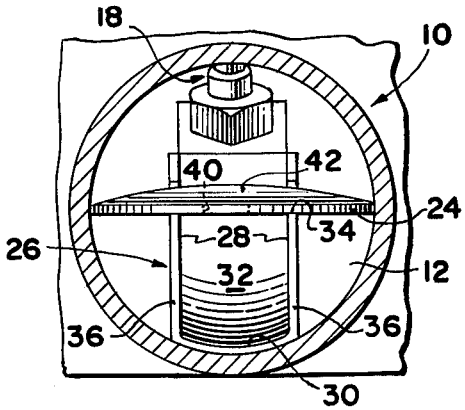
FIG. 3 is a cross-sectional view taken on the line 3—3 of FIG. 1.

As best seen in FIG. 2, side plates 28 have a horizontal top edge 34 and a straight, somewhat inclined front edge 36 which merge with each other at a location closely adjacent the pivotal axis 38 of choke plate 24 so that the rearward side of plate 24 lies flat against top edges 34 when the choke is in its open position and against forward edges 36 of ramp 28 when the choke is in its closed position shown in broken line in FIG. 1. A restricted opening 40 is formed in choke plate 24 to define an air inlet at the front or right-hand end of ramp 28 when the choke is in the closed position illustrated in broken line in FIG. 1. It will be noted that the upper portion of the choke plate 24 — that is the trailing or downstream end of the plate 24 when the plate is in its open position, is formed with a curved lip 42 for purposes which will be described below.

Figure 4:
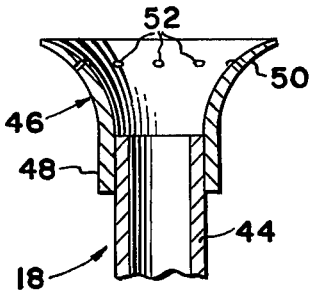
FIG. 4 is a cross-sectional view taken through the main nozzle of the carburetor of FIG. 1.

The main nozzle assembly 18 includes an open ended tube 44 fixedly mounted in housing 10 to provide communication between the fuel supply and the throat of venturi section 16. In accordance with the present invention, the upper or discharge end of tube 44 is formed with or has attached thereto an annular outwardly flared extension 46. As best seen in the cross-sectional view of FIG. 4, extension 46, in one form, includes a hollow cylindrical lower end portion 48 which may conveniently be dimensioned to mount upon the discharge end of tube 44 with a press fit. The upper end of lower end portion 48 merges into a smoothly outwardly flared upper end portion 50 which, in the form shown in FIG. 4, is formed with a series of restricted passages 52 symmetrically disposed with respect to the axis of the extension in tube 44. A fuel mixture discharged upwardly from tube 44 mixes with air passing inwardly through passages 52 and is fanned out in all directions toward the flared edge of extension 46 to be further mixed with the main stream of air flow passing around the outer edge of extension 46. This action increases the air velocity around the perimeter of extension 46 to achieve better fuel atomization, the normal air flow in the venturi section finding the higher air velocity close to the wall of the throat.

Figure 5:
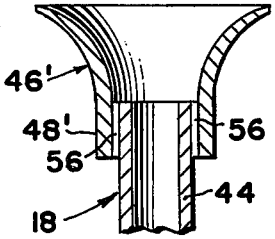
FIG. 5 is a cross-sectional view of a modified form of the main nozzle.
Figure 6:
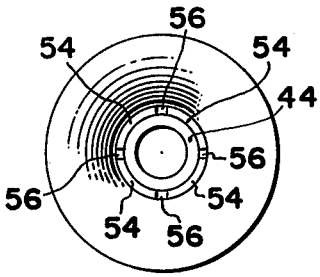
FIG. 6 is a top plan view of the nozzle of FIG. 5.

A modified form of extension is shown in FIGS. 5 and 6. The extension 46' of FIGS. 5 and 6 is shaped in generally the same form as extension 46 of FIG. 4, but is formed with a somewhat larger diameter lower end portion 48'. Circumferentially spaced radially inwardly projecting ribs or splines 54 on the inner surface of lower end portion 48' engage tube 44 with a press fit to mount the extension 46' on the end of tube 44, while the spaces 56 between adjacent ribs or splines 54 provide restricted air passages communicating with the interior passage of the bell mouthed extension to perform the same function as passages 52 in the embodiment of FIG. 4.

Further improvement in the fuel-air atomization is achieved by the action of ramp 28 and choke plate 24 in achieving a more efficient flow of air to the main nozzle.

During a starting operation, in carburetors of normal construction, the flow of air to the main fuel nozzle during cranking of the engine is of extremely low velocity which is normally insufficient to completely atomize the fuel discharged from the main nozzle. This is because air flowing through a small opening in a closed choke valve is discharged into the relatively large diameter intake passage where its velocity is substantially decreased. Movement of this slowly moving air upwardly through the venturi is normally not sufficient to carry all fuel droplets with it and therefore much of the starting fuel discharged from the main nozzle falls to the bottom of the intake pasage from which it must be drained to avoid excess fuel build-up and flooding.

In accordance with the present invention, the ramp 28, into which all incoming air is directed when the choke is closed via opening 40, provides a passage of a substantially reduced cross-sectional area as compared to the cross-sectional area of the intake passage, and hence the incoming air confined by ramp 28 moves with a much higher velocity than it would move if permitted to expand freely throughout the entire intake passage. Further, the smoothly curved rear wall 42 smoothly directs this flow upwardly with a minimum of turbulence, hence reducing the potential velocity loss incurred in changing the direction of air flow from horizontal to vertical. The narrowed passage between the side walls 28 of ramp 26 further confines the flow of air to substantial alignment with nozzle 18. Preferably, the spacing between side walls 28 is between one-third and one-sixth of a diameter of intake passage 12 with the side walls of ramp 26 being equally spaced on opposite sides of a vertical plane containing the center line of nozzle 18.

When the choke is fully opened, in the full line position shown in FIG. 1, the downstream or left-hand portion of the choke as viewed in FIG. 1 overlies side walls 28 to form a four-sided passage in the interior of the velocity ramp with the curved downstream lip 42 of the choke cooperating with the curved rear end wall 32 of the ramp to provide a discharge opening from which air is directed toward nozzle 18. Air flowing above the choke plate is likewise deflected upwardly by the upwardly curved lip 42. During idle or low throttle settings where the primary supply of fuel is from idling nozzles 20 and main nozzle 18 is just beginning to emit fuel, air velocity is generally low in the throat of venturi section 18. In this situation, the velocity ramp directs its concentration of air directly toward the main nozzle to better emulsify and mix fuel with air for improved operation.

While exemplary forms of the invention have been described in detail, it will be apparent to those skilled in the art that the disclosed embodiment may be modified. Therefore, the foregoing description is to be considered exemplary rather than limiting, and the true scope of the invention is that defined in the claims.

What is claimed is:

1. In a carburetor having housing means defining a vertically extending mixing chamber communicating at its lower end with a horizontally extending air intake passage, nozzle means projecting into the lower portion of said mixing chamber for discharging a fuel mixture into said chamber, and a choke plate mounted within said housing for pivotal movement about a horizontal axis extending transversely of said intake passage between a closed position blocking said inlet passage and an open position wherein said plate lies in a horizontal general plane within said passage; the improvement comprising a pair of spaced parallel vertical side plates projecting upwardly from the bottom of said inlet passage at locations spaced inwardly from the sides of said inlet passage between said choke plate and said mixing chamber, a rear wall extending transversely between said side plates and curving smoothly upwardly from said bottom of said inlet passage beneath said nozzle means, said side plates and said rear wall defining a flow passage in the lower central portion of said intake passage of a cross-sectional area substantially less than that of said intake passage for smoothly deflecting air flowing therethrough upwardly toward said nozzle means, said side plates having parallel front edges engageable with the rearward side of said choke plate when said choke plate is in said closed position, and means defining a restricted opening through said choke plate constituting an inlet to said flow passage when said choke plate is in said closed position.

2. The invention defined in claim 1 further comprising horizontal top edges on said side plates engageable with said choke plate when said choke plate is in said open position, and an upwardly curved lip on the trailing or downstream edge of said choke plate for deflecting air passing along the top of said choke plate when said choke plate is in said open position upwardly toward said mixing chamber.

3. The invention defined in claim 2 wherein said horizontal axis of pivotal movement of said choke plate passes substantially through the juncture of said top and front edges of said side plates.

4. In a carburetor having housing means defining a vertically extending mixing chamber communicating at its lower end with a horizontally extending air intake passage, nozzle means projecting into the lower portion of said mixing chamber for discharging a fuel mixture into said chamber, and a choke plate mounted within said housing for pivotal movement about a horizontal axis extending transversely of said intake passage between a closed position blocking said inlet passage and an open position wherein said plate lies in a horizontal general plane within said passage; the improvement wherein said nozzle means comprises a tube having an open discharge end portion in said mixing chamber, an annular outwardly flared tubular extension coaxially mounted on said end portion in surrounding relation thereto, and a plurality of axially extending circumferentially spaced radially projecting ribs on the inner surface of said tubular extension seated on the outer surface of said tube to define a plurality of restricted passageways through said extension symmetrically disposed about the axis of said tube, means defining a restricted opening in said choke plate, and ramp means in said inlet passage defining a flow passage through said intake passage of a cross-sectional area less than that of said inlet passage for guiding air flowing through said opening when said choke plate is in said closed position to said nozzle means.

* * * * *